United States Patent [19]

Chiappini

[11] Patent Number: 5,033,204

[45] Date of Patent: Jul. 23, 1991

[54] PROCESS AND APPARATUS FOR CONTINUOUSLY DEHYDRATING FABRICS IN ROPE FORM

[75] Inventor: Luigi Chiappini, Bergamo, Italy

[73] Assignee: MCS Officina Meccanica S.p.A., Italy

[21] Appl. No.: 530,762

[22] Filed: May 30, 1990

[30] Foreign Application Priority Data

Jun. 5, 1989 [IT] Italy ..... 20781 A/89

[51] Int. Cl.[5] ..... F26B 5/08

[52] U.S. Cl. ..... 34/8; 34/17; 34/18; 34/70; 34/58; 57/335

[58] Field of Search ..... 34/151, 18, 8, 70, 71, 34/58, 95, 111, 17; 57/335, 348

[56] References Cited

U.S. PATENT DOCUMENTS

| | | | |
|---|---|---|---|
| 2,657,472 | 11/1953 | Fry, Jr. | 34/8 |
| 3,686,853 | 8/1972 | Rasmussen et al. | 57/335 |
| 4,147,019 | 4/1979 | Novak | 57/348 |
| 4,726,180 | 2/1988 | Naylor et al. | 57/335 |
| 4,936,087 | 6/1990 | Mori et al. | 57/348 |

*Primary Examiner*—Henry A. Bennett
*Assistant Examiner*—Denise L. F. Gromada
*Attorney, Agent, or Firm*—Diller, Ramik & Wight

[57] ABSTRACT

The dehydration process substantially consists in causing the fabric in rope form to continuously advance between at least two pairs of pressing rolls, with it being simultaneously submitted to a false twisting. The false twist causes a wringing of the fabric with the consequent partial evacuation of the liquid the fabric is sodden with. In order to improve the dehydration, a centrifugation of the twisted fabric is provided. The apparatus substantially comprises a twisting organ capable of giving a false twist to the running fabric. The twisting organ can be constituted by a revolving structure capable of causing the fabric to run along a path outside its advancement axis, with the fabric thereby simultaneously undergoing a twist and a centrifugation.

16 Claims, 2 Drawing Sheets

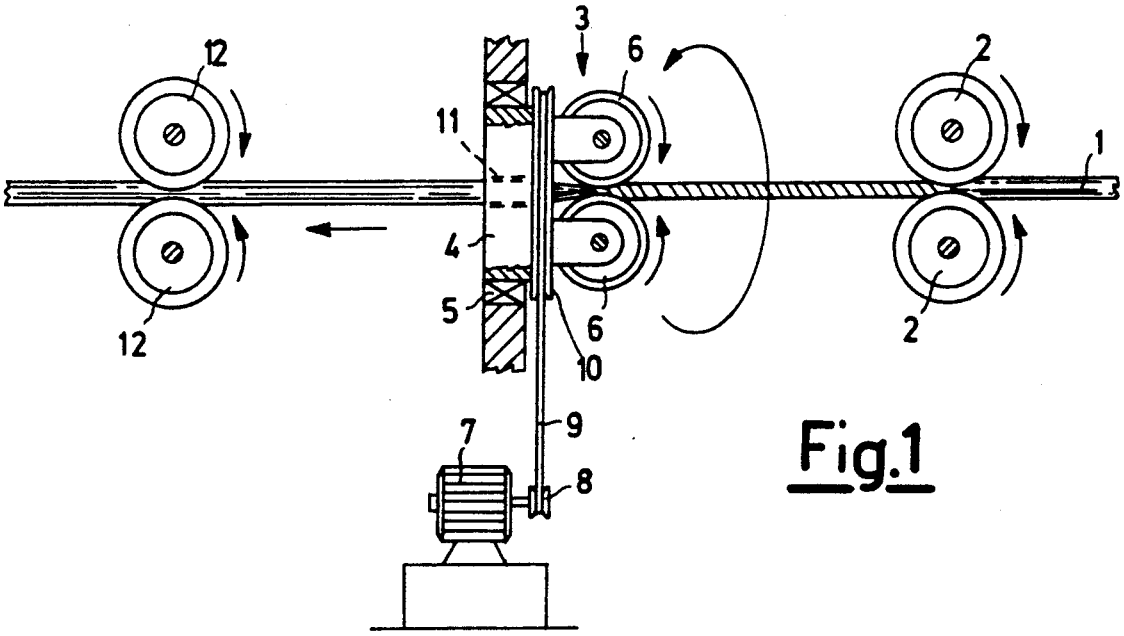
Fig.1
Fig.2
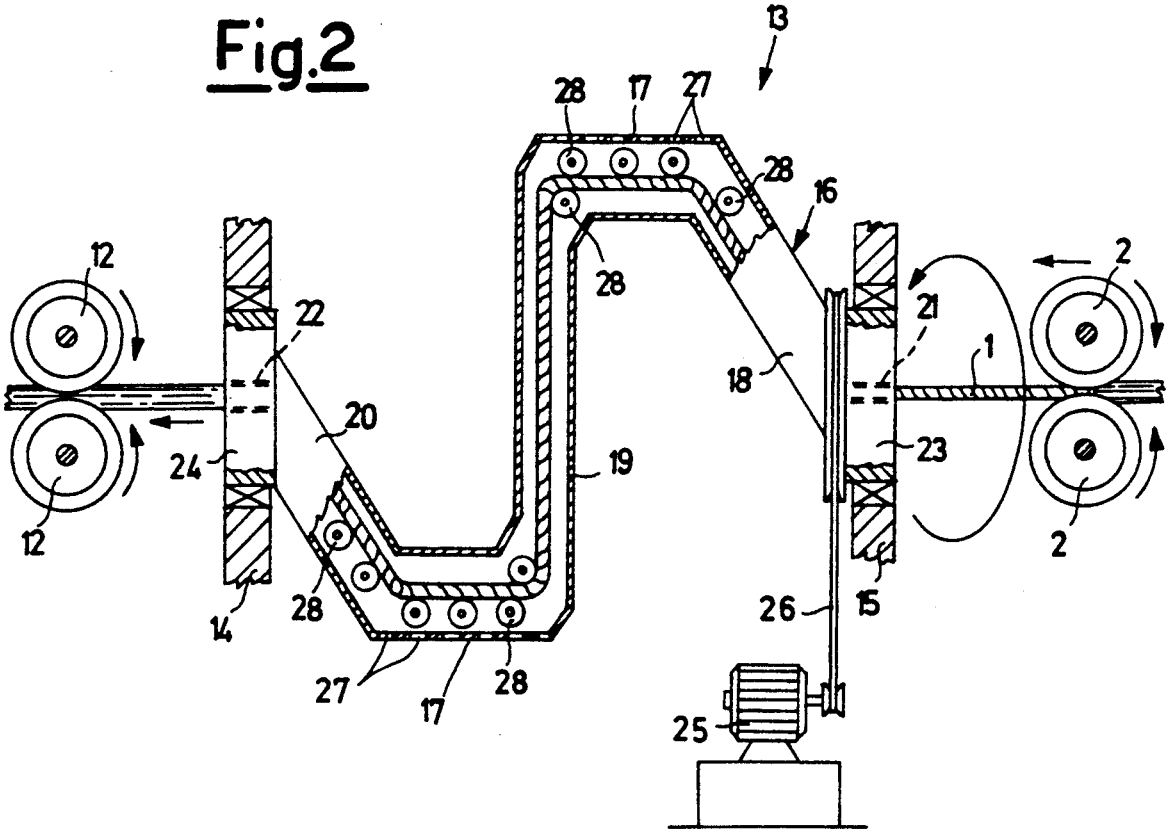

PROCESS AND APPARATUS FOR CONTINUOUSLY DEHYDRATING FABRICS IN ROPE FORM

BACKGROUND OF THE INVENTION

The present invention relates to a process and apparatus for continuously dehydrating fabrics in rope form.

It is well-known that in order to perform the continuous dehydration of fabrics, wringing rolls are prevailingly used, which are commonly denominated "mangles" or "paddlers", and are arranged as pairs through which the fabrics, by being squeezed between the rolls, undergoing a wringing which causes the expulsion (as a function of applied pressure values) of large portion of the liquid which soddens the fabrics.

Other, less diffused systems, provide for the fabrics to slide above one or more pipe(s) equipped with holes or slots, through which a suction is drawn in order to remove most liquid contained in the fabric.

Both of these systems can be advantageously used in order to treat fabrics in open-width form, but they yield very poor results when they are used in order to dehydrate fabrics in rope form, in that the shape of the fabric in rope form is not very suitable for an efficacious expulsion of the liquid either by simple wringing or by suction.

Therefore, in order to dehydrate fabrics in rope form batchwise systems are often used, such as, e.g., basket centrifuges into which a batch of fabric is charged and then, when the centrifugation is ended, is discharged from the centrifuge. One will realize that these batchwise systems, although more achieving satisfactory results as regards the amount of liquid extracted from the fabric per unit weight, are however more time consuming and require more burdensome means in order to charge and discharge the fabrics to/from the centrifuges, and therefore are not very advantageous from an economical viewpoint.

SUMMARY OF THE INVENTION

The main purpose of the present invention is of providing a process and apparatus by means of which fabrics in rope form can be continuously dehydrated with decidedly better results than as obtainable by means of the continuous systems used to date, and, on the contrary, with results comparable to those presently obtainable in the dehydration of fabrics in open-width form.

Furthermore, with the present invention is advantageous from an economic viewpoint, thanks to the use of simple means in the realization of the apparatus and low costs and high efficiencies.

In order to achieve the above purposes, according to the present invention a process is provided for continuously dehydrating fabrics in rope form of the type in which the fabric is continuously advanced between at least two pairs of pressing rolls installed along a fabric advancement axis, which is characterized in that along the stretch between said two pairs of rolls, the fabric is submitted to a false twist.

Thanks to the twisting of the fabric besides the wringing of the same fabric by the rolls, a torsional wringing of the same fabric is accomplished along a certain stretch of its running path, with the result that the expulsion of a larger amount of liquid from the fabric is accomplished. By suitably varying the speed of revolution of the twisting organ relatively to the speed of linear advancement of the same fabric, the number of twists per unit length of fabric, and the tension of the fabric can be varied, with the result that a wringing action is obtained which is the better, the larger the number of twists, and the consequent necessary tension of the fabric.

Inasmuch as the fabric is submitted to a false twisting as it advances, downstream of the twisting organ the fabric resumes its initial, substantially linear shape owing to the effect of the untwisting which takes place downstream of the twisting organ.

Advantageously, the twisted fabric can be submitted to a centrifugation, with the degree of dehydration being consequently further improved.

In order to practice the process according to the present invention, an apparatus is proposed which comprises at least two pairs of pressing rolls installed along a fabric advancement axis, with at least the downstream pair of pressing rolls being suitable for dragging the fabric with a continuous motion, which apparatus is characterized in that between the two pairs of pressing rolls at least one twisting organ is provided, which is suitable for causing the fabric to rotate around the advancement axis, so as to give the fabric a false twist.

According to a further aspect of the present invention, the twisting organ can be combined with a centrifugation unit, suitable for centrifuging the twisted fabric. Such a unit can be constituted by a revolving structure which defines for the fabric a running path comprising one or more stretches parallel to the twisting axis and spaced apart from it. In that way, the fabric undergoes the action of centrifugation along its running path, and in particular along said parallel stretches. The revolution of the whole centrifugation unit makes it possible for the fabric to be automatically maintained in its twisted condition until it leaves the unit by again running along its advancement axis.

The apparatus is particularly simple from the structural viewpoint and in particular in its form of practical embodiment equipped with the centrifugation unit it makes it possible to obtain a very high dehydration rate, comparable to that which can be obtained by means of the presently available padders, or the like, used on fabric in open-width form.

Further details and advantages of the present invention will become more apparent from the following disclosure of the invention, and of preferred forms of practical embodiments thereof, as illustrated for exemplary purposes in the hereto attached drawings, to a period (.).

BRIEF DESCRIPTION OF THE DRAWINGS

FIG. 1 shows in schematic form a first embodiment of an apparatus according to the present invention;

FIG. 2 shows another embodiment of an apparatus of the invention equipped with the centrifugation unit;

DESCRIPTION OF THE PREFERRED EMBODIMENTS

Figure 3:
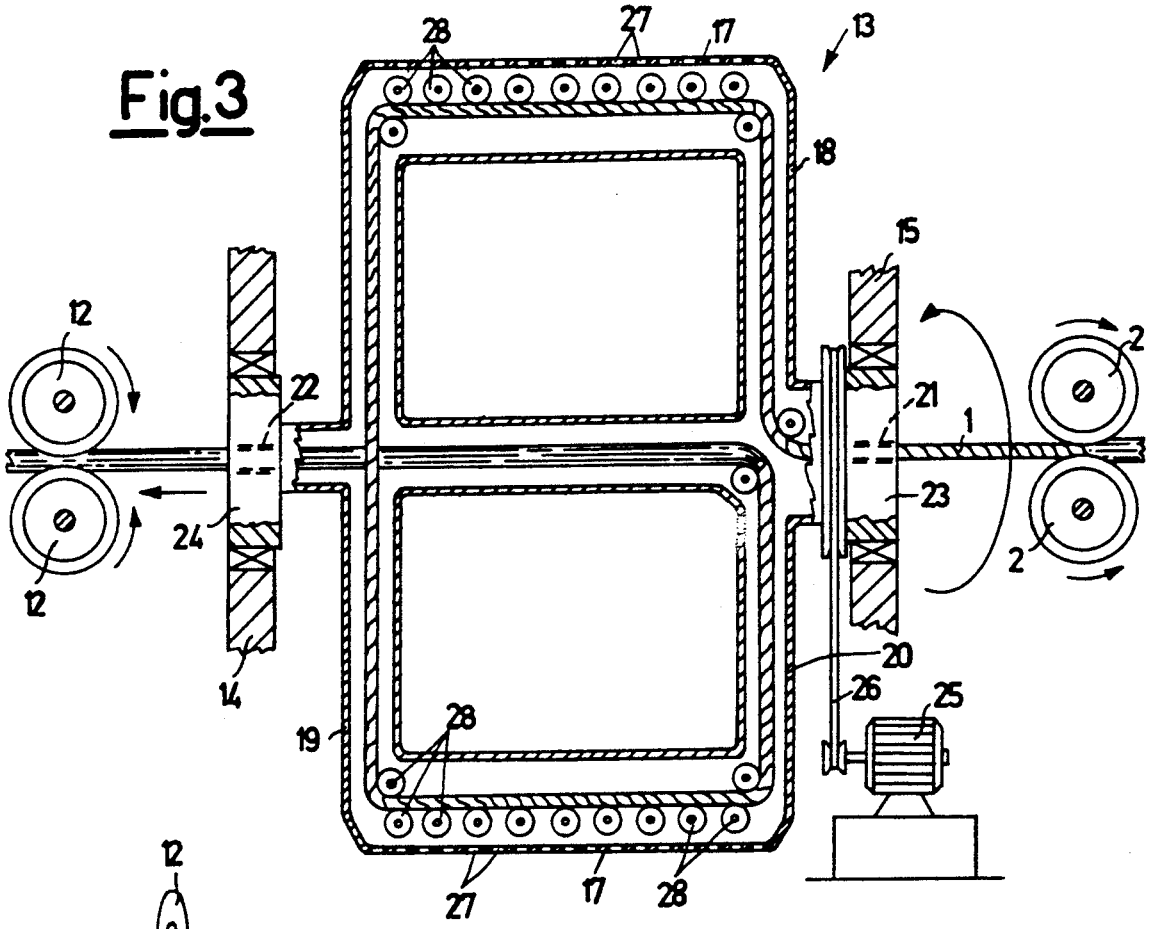
FIG. 3 illustrates another embodiment of the invention equipped with the centrifugation unit.

Referring first to FIG. 1, a fabric 1 in rope form is caused to run through a first pair of pressing rolls 2, not necessarily driving rolls, made as splined rolls in a per se known way and provided with an elastic coating, in order to press the fabric 1 running between them.

At a certain distance downstream of the rolls 2 a twisting organ 3 is installed, which is substantially constituted by a revolving structure 4, supported by bearings 5 coaxially with the axis of advancement of the fabric 1 in rope form and rotatably carrying a pair of pressing twisting rolls 6 having their revolution axis perpendicular to the axis of advancement of the fabric 1 and spaced apart from each other substantially in the same way as of the rolls 2. The rolls 6, which can be of the same type as of the rolls 2, can be mounted idling, motor-driven, or sightly braked. The rotary structure 4 can be driven to revolve around the axis of advancement of the fabric 1 by means of a motor 7 through a belt transmission 8, 9, 10. The structure 4 is provided with an axial through opening 11 for the fabric 1.

Downstream the twisting organ 3, at a certain distance from it, which can advantageously be on the order of the distance between the twisting organ 3 and the first pair of rolls 2, a second pair of pressing rolls 12 are installed, which can be the same type as of the rolls 2 and are driven to rotate by a motor in at a revolution speed related to the revolution speed of the twisting organ 3. The rotation of the rolls 12 causes the fabric 1 to continuously advance between the pairs of rolls 2 and 12 and through the twisting organ 3 and the revolution of the twisting organ 3 around the axis of advancement of the fabric 1 causes the fabric 1 to rotate around said axis, causing a twisting of the fabric 1 to take place between the rolls 2 and the twisting organ 3, the effect of which twisting is of wringing said fabric 1 which undergoes hence an efficacious continuous dehydration.

Downstream the twisting organ 3 the running fabric 1 undergoes a twisting contrary to the twisting it underwent upstream the same organ, with this untwisting compensating for the twists supplied to the fabric in rope form along the upstream stretch, and returning it to its original, untwisted condition, but with a content of liquid which is substantially smaller than the original liquid content. Thus, the fabric undergoes a false twisting along the stretch comprised between the roll pairs 2 and 12.

The revolution speed of the dragging rolls 12 is correlated with the revolution speed of the rolls 2 and this correlation is a function of the tension and elasticity of the fabric 1. The inlet roll pair 2 can be either driven to revolve at a smaller speed than of the outlet rolls 12 or, preferably, is submitted to a braking action, with the effect being that of causing a tension to arise in the fabric which is twisted by the twisting organ 3, while the fabric is being pulled by the rolls 12.

It should be observed that the length of the stretch between the inlet rolls 2 and the twisting rolls 6 is immaterial for the purposes of the twisting/untwisting equilibrium, and is meaningful as regards the time the fabric 1 remains under twisted conditions. For example, if such a length is assumed to be 1meter and if the fabric is caused to advance at the advancing speed of 30 meters/-minute (i.e., of 0.5 meters/second), the hold time of the fabric in the twisted state will be $1/0.5=2$ seconds.

By properly adjusting the ratio of the advancement speed of the fabric 1 to the number of revolutions of the twisting organ 3 around the twisting axis, the number of twists can be reached, which are suitable for submitting the same fabric to an efficacious wringing for dehydration purposes. The efficiency of wringing is limited by the value of the tension the fabric can withstand and which has to be applied to the fabric 1 along the stretch between the roll pairs 2 and 6. This tension, which depends on the nature of the fabric, is essential in order to counteract the effect of shortening of the fabric 1 due to the twist formed therein. In fact, in the absence of such a tension, entanglement of the fabric would occur.

Tests indicate that the number of applicable twists is first of all a function of the weight of the fabric 1 per linear meter, as well as of the nature and composition of the fabric 1. In general, the maximum applicable number of twists per meter increases with decreasing weight per linear meter of the fabric 1.

According to the invention, the twisted fabric 1 can be submitted to a step of centrifugation, which causes a further efficacious dehydration of the fabric. For that purpose, some forms of practical embodiment of the apparatus according to the present invention are shown in FIGS. 2–5 for exemplifying purposes, in which the twisting organ is combined with a fabric centrifuging unit. For equal or equivalent elements, the same reference numerals are used.

On considering the example shown in FIG. 2, a centrifugation unit 13 is rotatably supported between two supports 14 and 15 and is essentially constituted by guide means for guiding the fabric 1, e.g., in the form of a tube 16 having a generally bent "S"-shape, with two stretches 17 substantially parallel to the revolution axis and spaced apart from it, and with an inlet stretch 18, a connection stretch 19 and an outlet stretch 20 generally running in radial direction. The fabric enters the tube 16 and leaves it, respectively through axial openings 21 and 22 provided through support flanges 23 and 24 at the ends of the tube 16. The revolution of the centrifugation unit 13 is obtained, e.g., by means of a motor 25 through a belt transmission 26. Along the stretches 17 openings 27 are provided on the external side of the tube in order to allow the expelled liquid to escape.

Inside the interior of the tube 16 fabric guide rollers 28 can be installed, which are suitable for guiding the fabric 1 along the bends, and for reducing friction. The speed of advancement of the fabric 1 is determined by the pair of dragging, outlet rolls 12, corresponding to the outlet rolls 12 of FIG. 1. The inlet rolls 2 are arranged and operate in the same as shown in the example of FIG. 1.

As one can see from FIG. 2 of the drawing, the revolution of the unit 13 around the axis of advancement of the fabric 1 automatically causes the twisting of the fabric, owing to the change in direction of the advancing fabric, and to the moving away thereof from its advancement axis after the same fabric entering the centrifugation unit 13, with said fabric being consequently obliged to rotate around the axis of the centrifugation unit 13. Only when the fabric 1 leaves the unit 13, and returns back to advance along its feeding axis—coincident with the axis of revolution of the centrifugation unit—the reversal of the twisting direction takes place, causing the fabric to be totally untwisted. The same effect would take place in case one single stretch 17 is used.

The time during which the fabric is submitted to the torsional wringing depends on the length of the path inside the tube 16 and on the advancement speed of the fabric.

The time during which the fabric is submitted to centrifugation essentially depends, on the contrary, on the length of the peripheral stretches 17 of the centrifugation path, besides the advancement speed of the fabric.

Therefore, in relation with the limits imposed by the maximum acceptable number of twists, the fabric advancement speed and the revolution speed of the centrifugation unit can be selected as a function of optimum characteristics of dehydration or as a function of the installation of the dehydration apparatus in a continuous treatment line.

The value of the centrifugal force the fabric is subjected to will obviously depend on the radius of the peripheral stretches 17, and on the square of the revolution speed of the centrifugation unit 13.

In FIG. 3 a further form of practical embodiment is shown of the apparatus according to the present invention, which, with its overall dimensions substantially being the same as of FIG. 2, is provided with longer peripheral centrifugation stretches 17 and therefore, with the speed of advancement of the fabric, and the revolution speed of the centrifugation unit being the same, makes it possible to increase the centrifugation time, and hence increase the dehydration effect.

Figure 4:
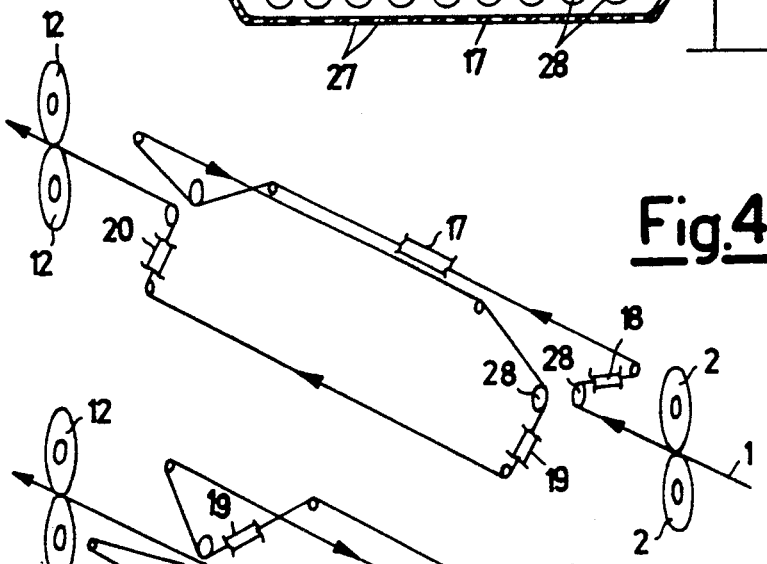
FIG. 4 and 5 schematically show the path of the fabric in two further embodiments of an apparatus according to the present invention.
Figure 5:
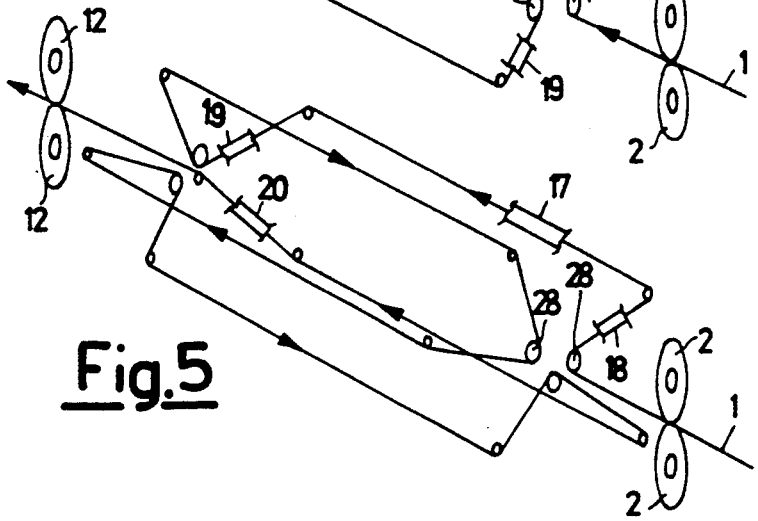

In order to prevent fabric crossing points between the radial stretches and the axial stretches of the fabric path, an odd number of peripheral parallel stretches 17 should be preferably accomplished, such as, e.g., as shown in FIGS 4 and 5, with such stretches being distributed on a cylindrical surface coaxial with the axis of the centrifugation unit, so that the peripheral stretches 17 may lay, together with the relevant radial stretches 18, 20 on planes convergent towards the axis of the centrifugation unit. It will be easily understood that, with the overall dimensions in the diametrical direction and the revolution speed being the same, the larger the number of the centrifugation stretches 17 the greater the dehydrating effect.

Advantageously, the motor means which drive the rolls 12 and possibly the rolls 2, as well as the motor means which drive the centrifugation unit 13 are adjustable, so as to adapt the apparatus from time to time to the optimum conditions as a function of the treated fabric.

Optimum results were obtained, e.g., with values of speed of advancement of the fabric on the order of 60 meters/minute and values of revolution speed of the centrifugation unit on the order of 600–700 rpm. The dehydration of fabric could be increased up to a percentage of about 80 parts by weight of residual liquid per each 100 parts by weight of dry fabric.

In order to make it possible the initial end of the fabric 1 to be slid into the centrifugation unit 13 up to reach the outlet of same centrifugation unit, along portions of the tube 16 or the set of channels which define the path of the fabric, openings will be provided.

Instead of the fabric guide rolls 27 an anti-friction coating can be provided inside the interior of the tube 16 or of the various channels, which is suitable for reducing the fabric sliding friction.

Of course, an apparatus could be provided which comprises a plurality of twisting organs 3, e.g., two twisting organs arranged between relevant pairs of pressing rolls, and generating opposite-direction twists.

As it results evident from the above disclosure, a process and apparatus according to the present invention make possible, with limited means and costs, an efficacious dehydrating action carried out in a continuous manner on fabrics in rope form within very short times, such that on fabrics in rope form a dehydration is obtained, which is of the same order as of the dehydration obtainable to date on fabrics treated in open-width form only.

I claim:

1. Process for continuously dehydrating fabrics in rope form of the type in which the fabric is continuously advanced between at least two pairs of pressing rolls installed along a fabric advancement axis characterized in that along the stretch between said two pairs of rolls, the fabric is submitted to a false twist, and being further characterized in that the fabric is submitted to centrifugation.

2. Process according to claim 1, characterized in that the centrifugation of the fabric is carried out on twisted fabric.

3. Process according to claim 2, characterized in that the fabric is twisted and centrifuged by said fabric being caused to rotate while it is being advanced along a path comprising at least one stretch parallel to the axis of rotation of the fabric and at a certain distance from said axis.

4. Process according to claim 3, characterized in that the fabric is caused to advance along a path comprising a plurality of stretches parallel to the rotation axis, arranged distributed on a cylindrical surface.

5. Process according to claim 4, characterized in that said parallel stretches are provided in an odd number.

6. Process according to claim 1 characterized in that centrifugation of the fabric is effected by rotating the fabric at a rotation speed which is correlated with the fabric advancing speed.

7. Apparatus for continuously dehydrating fabrics in rope form, comprising at least two pairs of pressing rolls installed along a fabric advancement axis, with a downstream pair of said two pairs of rolls being constructed and arranged for dragging the fabric with a continuous motion, at least one twisting organ provided between the two pairs of pressing rolls, said twisting organ being constructed and arranged for causing the fabric to rotate around its advancement axis thereby giving the fabric a false twist, said twisting organ comprises a pair of pressing rolls having their axes perpendicular to the axis of the advancement of the fabric and rotatably supported by a structure which can be driven to revolve around said advancement axis.

8. Apparatus according to claim 7, characterized in that said twisting organ can be driven to rotate at a revolution speed correlated with the speed of advancement of the fabric.

9. Apparatus according to claim 7, characterized in that said two pairs of pressing rolls comprise a downstream dragging roll pair and an upstream braking roll pair.

10. Apparatus according to claim 7, characterized in that said two pairs of rolls comprise an inlet pair of rolls, and means for rotating said last-mentioned inlet pair of rolls at a smaller revolution speed than that of the outlet pair of rolls.

11. Apparatus for continuously dehydrating fabrics in rope form, comprising at least two pairs of pressing rolls installed along a fabric advancement axis, with a downstream pair of said two pairs of rolls being constructed and arranged for dragging the fabric with a continuous motion, at least one twisting organ provided between the two pairs of pressing rolls, said twisting organ being constructed and arranged for causing the fabric to rotate around its advancement axis thereby giving the fabric a false twist, said twisting organ includes a centrifugation unit equipped with fabric guide means for guiding said fabric along a path having at least one stretch parallel to the axis of revolution of said centrifugation unit and at a certain distance from it, and the axis of revolution of the centrifugation unit being coincident with the axis of the advancement of the fabric.

12. Apparatus according to claim 11, characterized in that said guide means are provided with a plurality of stretches parallel to the axis of revolution of the centrifugation unit, and arranged distributed on a cylindrical surface coaxial with said axis.

13. Apparatus according to claim 12, characterized in that said parallel stretches are provided in an odd number.

14. Apparatus according to claim 11, characterized in that said centrifugation unit is equipped with fabric guide roll means for guiding the fabric at least along bends in its advancement path.

15. Apparatus according to claim 11, characterized in that said centrifugation unit is equipped with fabric guide channels with an internal coating made from an anti-friction material.

16. Apparatus according to claim 11, characterized in that said centrifugation unit is so shaped as to define a fabric path of substantially "S"-shape.

* * * * *